US005839144A

United States Patent [19]

Willner

[11] Patent Number: 5,839,144

[45] Date of Patent: Nov. 24, 1998

[54] BOOT CLEANING APPARATUS

[76] Inventor: Byron J. Willner, 131 E. Broad St., Suite 206, Falls Church, Va. 22046

[21] Appl. No.: 870,360

[22] Filed: Jun. 6, 1997

[51] Int. Cl.[6] ..... A47L 23/02; A47L 23/22

[52] U.S. Cl. ..... 15/36; 15/34; 15/4; 15/112

[58] Field of Search ..... 15/112, 4, 21.1, 15/30, 31, 32, 34, 35, 36

[56] References Cited

U.S. PATENT DOCUMENTS

| | | | |
|---|---|---|---|
| 1,219,148 | 3/1917 | Pootmans | 15/34 |
| 3,094,727 | 6/1963 | Osteen | 15/4 |
| 3,729,761 | 5/1973 | Lashley | 15/34 |
| 3,831,217 | 8/1974 | Odawara | 15/34 |

*Primary Examiner*—Randall E. Chin
*Attorney, Agent, or Firm*—Alfred Hoyte, Jr.

[57] ABSTRACT

An automatic boot cleaning apparatus is provided. The apparatus has at least three brushes and a scraper. The brushes are positioned to apply scrubbing force to the underside of the sole of a boot or shoe, as well as the sides of the boot or shoe. The scraper is positioned behind the brushes and may be used to remove the excess mud or dirt from the boot or shoe. The apparatus is preferably powered by an AC motor which is connected to a source of AC power. The brushes may be rotated continuously in one direction, or oscillated thereby increasing the effectiveness of the cleaning operation. In an alternative embodiment, the device is connected to a source of fluid pressure and has a plurality of fluid outlet nozzles secured to the scraper. The nozzles are arranged to spray fluid directly onto the brushes and thus are capable of effecting a self cleaning operation. The entire housing, including the activation switch, is sealed against environmental effects allowing for outdoor use.

6 Claims, 9 Drawing Sheets

BOOT CLEANING APPARATUS

BACKGROUND OF THE INVENTION

1. Field of the Invention

The present invention relates to boot cleaners. More specifically, it relates to an improved automated boot cleaning apparatus designed to remove mud and heavy dirt from the soles and sides of a boot or shoe.

2. Description of the Prior Art

As will be seen, the simplicity and effectiveness of my invention is not rivaled in the prior art.

U.S. Pat. No. 5,025,528 issued to Burey et al. discloses a footwear cleaning machine which has a plurality of stations for cleaning footwear, each station having a pair of brushes associated therewith. The device has a plurality of brushes each rotating about a vertical axis. At least one of the brushes has a stream of fluid directed thereon to effect application of the fluid to the footwear. By contrast, the present invention comprises a boot or shoe cleaning device having only a single cleaning station which may optionally include a source of fluid under pressure. The brushes rotate about both horizontal and vertical axes with at least one brush having its bristles positioned to contact the underside of the shoe or boot. Thus, heavy mud can be removed from between the tread of the boot more easily.

U.S. Pat. No. 5,418,996 issued to Chen discloses a shoe washing machine which has a plurality of conduits for directing water onto a shoe to effect cleaning thereof. A plurality of brushes attached to the conduits rotate while supplying water to the surface of the shoe in order to clean the sides and heel of the shoe. By contrast, the present invention contemplates a shoe and boot cleaner which has a plurality of brushes to clean the shoe or boot. At least one of the brushes is positioned to clean the underside of the shoe, the brush acting in concert with a scraper for removing mud or other heavy dirt or debris from the shoe or boot.

U.S. Pat. No. 3,226,750 issued to Leonard discloses a golf shoe cleaning device having a pair of mutually opposed brushes. By contrast, the device of the present invention has at least three brushes, with at least one of the brushes contacting the underside of the shoe or boot.

U.S. Pat. No. 3,849,822 issued to Oulletteto discloses a footwear cleaning machine having a recessed opening and a plurality of brushes disposed therein. By contrast, the device of the present invention has no enclosure for the brushes thereby reducing the possibility of the user's foot becoming lodged therein. The device is designed primarily for outdoor use, e.g., at construction sites or other outdoor industrial work area.

None of the above inventions and patents, taken either singly or in combination, is seen to describe the instant invention as claimed.

SUMMARY OF THE INVENTION

Briefly, the invention comprises an automatic boot cleaning apparatus. The apparatus has at least three brushes and a scraper. The brushes are positioned to apply scrubbing force to the underside of the sole of a boot or shoe, as well as the sides of the boot or shoe. The scraper is positioned behind the brushes and may be used to remove the excess mud or dirt from the boot or shoe. The apparatus is preferably powered by an AC motor which is connected to a source of AC power. The brushes may be rotated continuously in one direction, or oscillated thereby increasing the effectiveness of the cleaning operation. In an alternative embodiment, the device is connected to a source of fluid pressure and has a plurality of fluid outlet nozzles secured to the scraper. The nozzles are arranged to spray fluid directly onto the brushes and thus are capable of effecting a self cleaning operation. The entire housing, including the activation switch, is sealed against environmental effects allowing for outdoor use.

Accordingly, it is a principal object of the invention to provide a new and improved boot and shoe cleaning apparatus.

It is a major object of this invention to provide a boot and shoe cleaning apparatus which can effectively remove mud or heavy debris from a boot or shoe.

It is another object of the invention to provide such an improved boot and shoe cleaning apparatus which is suitable for outdoor use and storage.

It is still another object of the invention to provide an improved boot and shoe cleaning apparatus having a plurality of brushes oscillating in different directions.

It is another object of the invention to provide an improved boot and shoe cleaning apparatus which has all of its electrical components encased in a water/element resistant housing.

It is yet another object of the invention to provide an improved boot and shoe cleaning apparatus which is connected to a source of fluid under pressure for applying fluid to the boot or shoe to be cleaned.

It is yet another object of the invention to provide an improved boot and shoe cleaning apparatus which has a rigid scraper for removing excess mud or debris from the boot or shoe prior to or during the cleaning operation.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
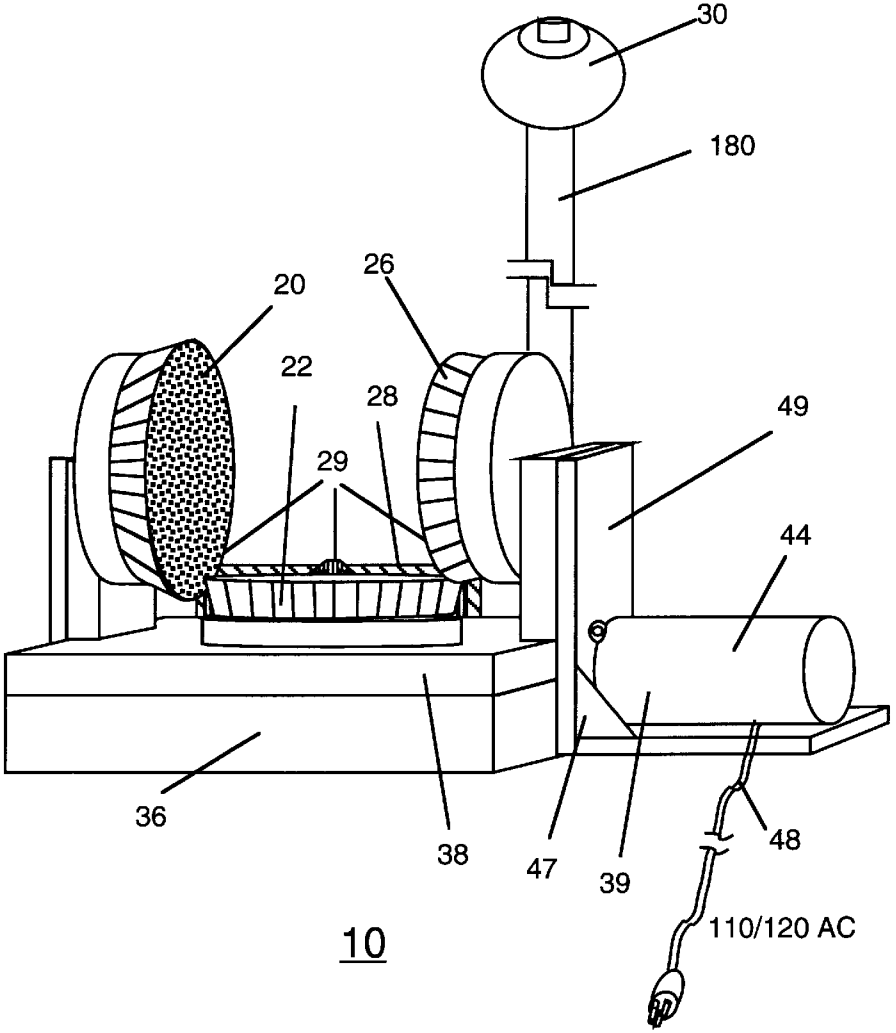
FIG. 1 is a perspective view of the boot and shoe cleaning apparatus of the present invention.
Figure 2:
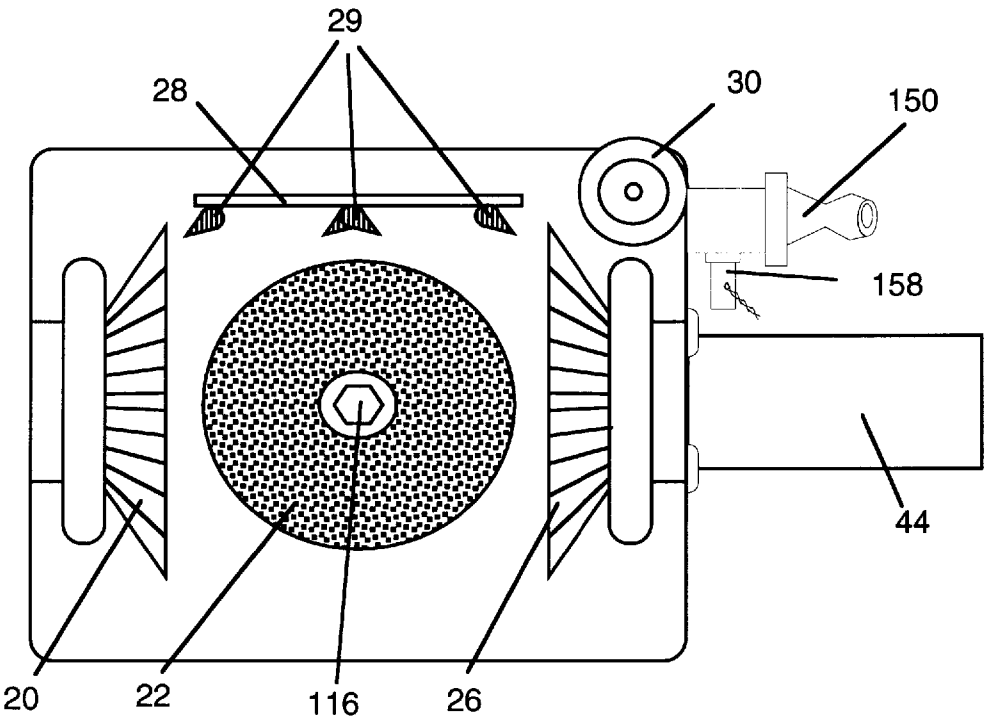
FIG. 2 is a top view of the boot and shoe cleaning apparatus of the present invention.
Figure 3A:
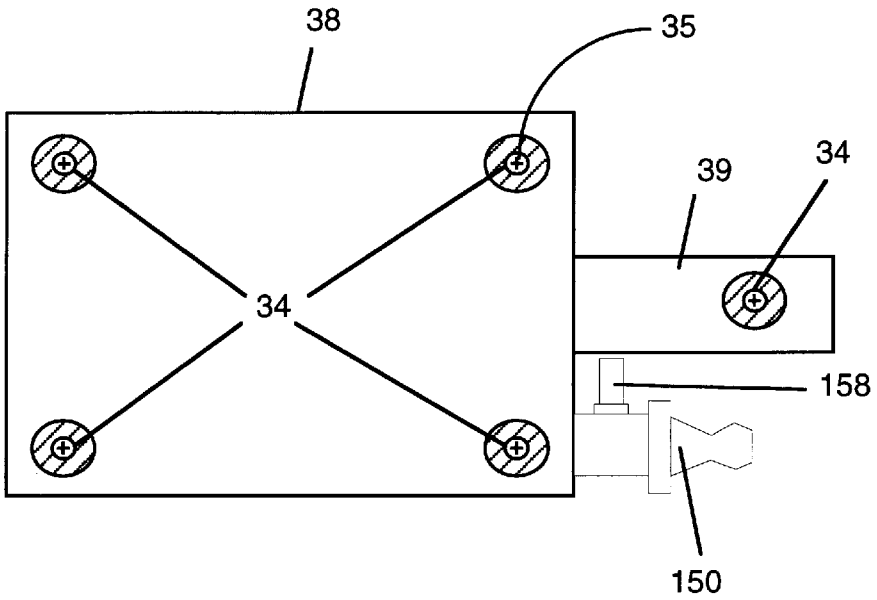
FIG. 3 is a bottom view of the boot and shoe cleaning apparatus of the present invention.
Figure 3B:
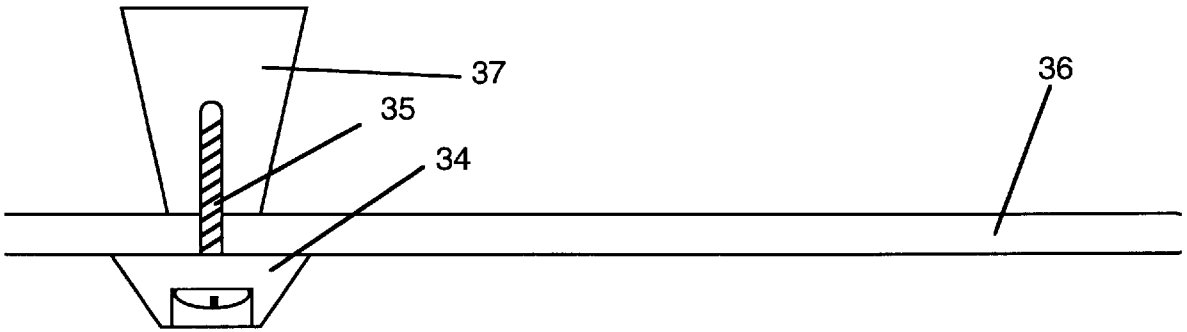

Referring now to FIGS. 1–3, the boot and shoe cleaner of the present invention, generally indicated by the numeral 10, is shown. The boot and shoe cleaner 10 is designed to remove mud and other heavy debris such as clay from the underside and side portions of a shoe or boot. The device is designed primarily for outdoor use on relatively heavy footwear such as construction boots and the like, but may also be used with regular walking shoes.

A typical installation of the boot and shoe cleaner 10 would be at a construction site. The device could be used to prevent workers from tracking dirt into the building after interior floors have been installed. Another possible installation would be at outdoor parks to prevent patrons from soiling the interiors of their cars when returning from a hike. Numerous other uses of the boot and shoe cleaner of the present invention will become apparent to one familiar with the art.

The boot and shoe cleaner 10 has three main brushes 20, 22, 26 which can be used to scrub the underside and sides of a boot or shoe which is placed into contact therewith. In the preferred embodiment the brushes 20, 22, 26 would be relatively stiff, heavy duty brushes which could withstand wetting while still having sufficient resiliency to remove mud and heavy debris from the boot or shoe (not shown). Of course, softer brushes may be used depending upon the installation and the type of boot or shoe to be cleaned.

As can be seen from the Figures, brushes 20 and 26 rotate about a substantially horizontal axis, while brush 22 rotates about a vertical axis. Brushes 20 and 26 are intended for cleaning the sides of a boot or shoe while brush 22 is positioned to clean the underside of a boot or shoe.

A scraper 28 is positioned rearwardly of the brushes 20, 22, and 26 and may be used to scrape the mud or other debris from the boot or shoe prior to or during the cleaning operation. The scraper 28 will reduce buildup on the brushes 20, 22, and 26 will facilitating quick and efficient cleaning of the boot or shoe. In a preferred embodiment, the scraper 28 has a plurality of nozzles 29 connected thereto which can supply a source of fluid under pressure to assist in cleaning of the boot or shoes as well as the brushes 20, 22, 26 as will be explained later.

Power to rotate the brushes is selectively applied by a start switch member 30 which controls the application of power to a motor as will be explained later. The start switch member 30 is positioned for convenient user access and is housed to prevent corrosion or other damage as may occur from exposure to the environment as will be explained in more detail later.

The underside of the device 10 has a plurality of feet 34 which are secured to the bottom 36 of the exterior surface of the housing 38. Preferably the feet 34 have an identical threaded member 37 disposed interiorly of the housing allowing a screw 35 to be threaded therethrough thereby securing both member 34 and 35 together about the bottom wall 36 of the housing 38. The feet 34 are preferably made of heavy duty rubber and arranged in the corners at the bottom 36 of the housing to prevent slippage of the device 10 while in use. An additional foot 34 is secured to the underside of an extended portion 39 of the housing 38.

The housing 38 contains the transmission 46 (FIGS. 4–7), the motor 44 being secured to the extended portion 39 of the housing. The motor 44 is connected to a source of electric power via power cord 48. Preferably a heavy duty cord is used to prevent fraying which may occur during outdoor use.

The motor 44 is further stabilized by L-shaped bracket 45, which includes welded gussets 47, which are secured to the side of the housing 38. The bracket 45 underlies the extended portion 39 of the housing 38.

Figure 4:
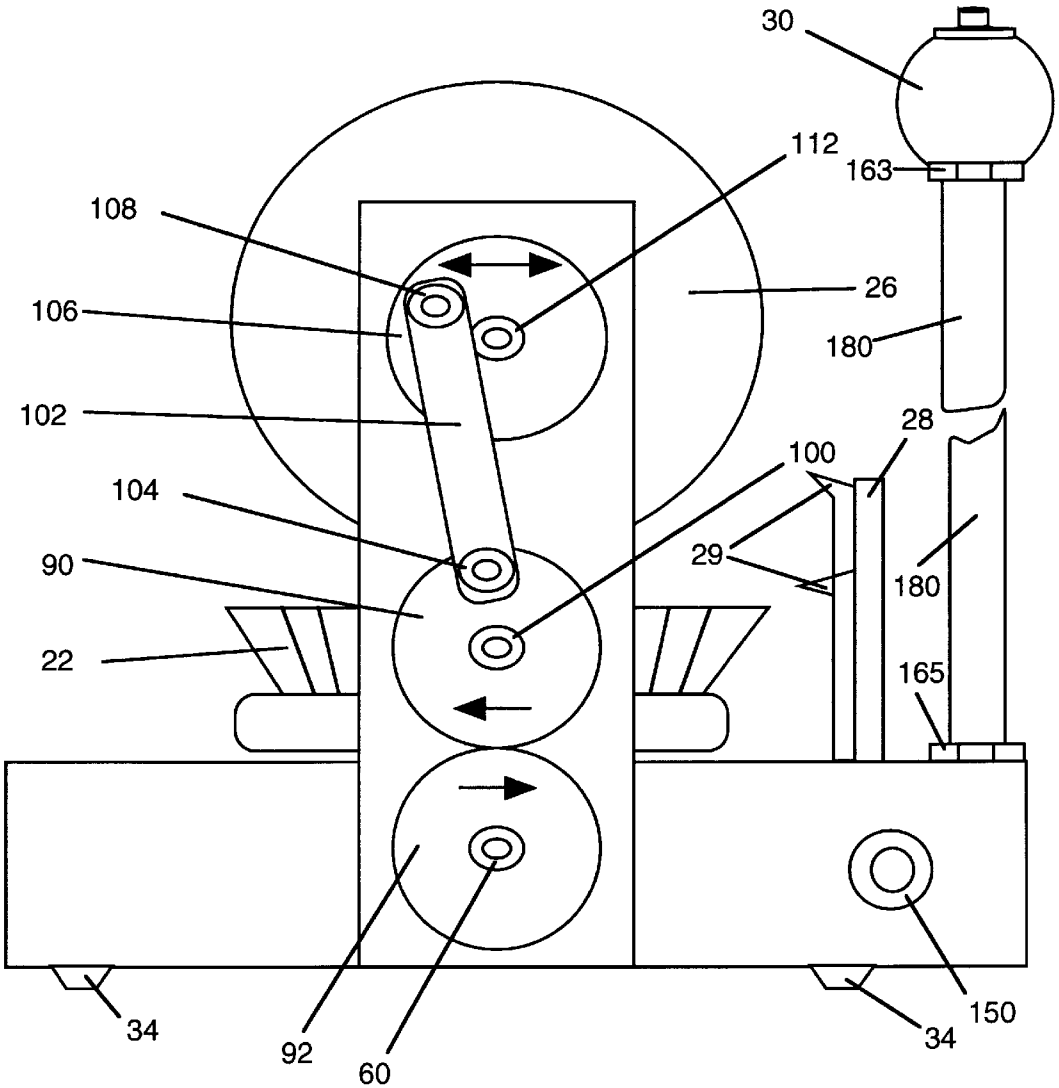
FIG. 4 is a side view, partly in section, of a first embodiment of the boot and shoe cleaning apparatus of the present invention detailing the structure of a transmission which will cause oscillatory rotation of the associated brushes.
Figure 5:
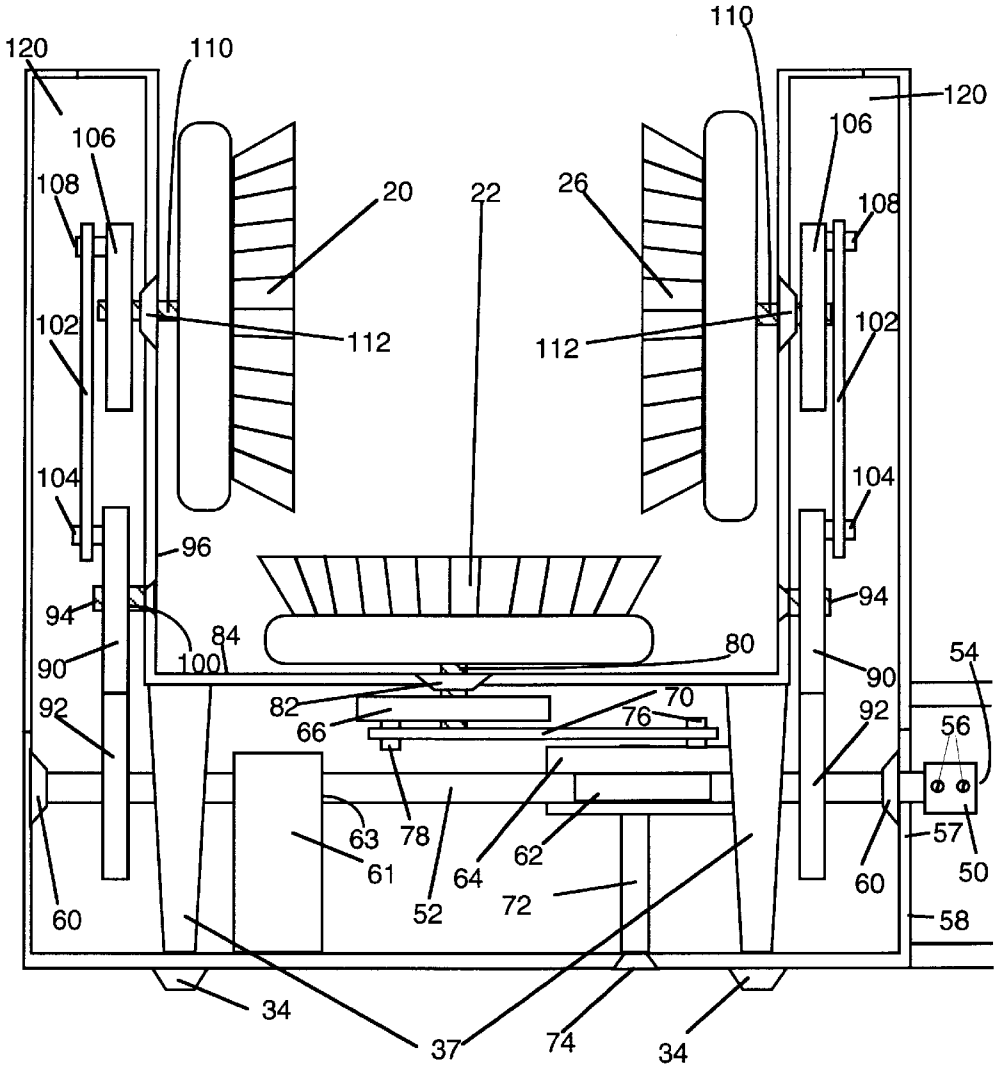
FIG. 5 is a front view, partly in section, of the first embodiment of the boot and shoe cleaning apparatus of the present invention detailing the structure of the transmission which will cause oscillatory rotation of the associated brushes.

Two types of transmissions may be used with the boot and shoe cleaner 10 of the present invention. In the preferred embodiment, a transmission capable of imparting oscillating motion to the brushes 20, 22, 26 is used with the invention. One such transmission is depicted in FIGS. 4 and 5. A motor coupler 50 couples a drive shaft 52 to the output shaft (not shown) of the motor 44. The motor coupler 50 has an aperture 54 sized to receive the motor output shaft (not shown), the motor output shaft having a flattened end portion (not shown). The motor coupler 50 has a pair of apertures formed therein through which a pair of screws 56 may be inserted. The screws 56 may be threaded into the screw holes until they abut the flattened end of the motor output shaft thereby coupling the drive shaft 52 thereto. It should be noted that wherever necessary, shaft ends are flattened to prevent slippage at the coupling end. Also, all shafts have "C" ring slots/grooves to keep their connecting parts in place. Of course, another functionally equivalent coupling arrangement may be used. The drive shaft 52 protrudes through an aperture in a wall 57 of housing 38. A sealed bearing 60 is preferably used to ensure smooth operation of the drive shaft 52 and to avoid friction from occurring as a result of interaction between the wall 57 and the drive shaft 52. The drive shaft 52 is supported by a mounting stand off 61 which has internal bearings 63 therein to ensure smooth rotation of the drive shaft 52.

The drive shaft 52 turns a worm gear 62, which in turn rotates a first lower brush gear 64 containing sealed bearings (not shown) and secured by "c" rings (not shown), the first lower brush gear 64 imparting an oscillating motion to a second lower brush gear 66 by way of a coupler link 70. A shaft 72 supporting lower brush gears 64, 66 extends into the bottom of housing 38 and is connected thereto by a screw 74. The first and second lower brush gears 64, 66 are connected to the coupler link by shafts 76 and 78 respectively. A shaft 80 is connected to the center of the second lower brush gear 66 and extends vertically upwards into the center of lower brush 22 where it is firmly secured thereto. The shaft 80 is enclosed by a sealed bearing 82 at the point where it passes through the upper horizontal wall 84 of the housing 38. The shaft 80 rotates with the second lower brush gear 66 and imparts oscillatory motion to the lower brush 22.

Side brushes 20, 26 are caused to oscillate in a similar manner and at the same rate as lower brush 22, using a gear and coupler arrangement similar to that described above. A pair of lower side gears 90 are coupled to drive gears 92 and held in place by "c" rings, the drive gears 92 being located on and rotating with the drive shaft 52. Lower side gears 90 are supported by shafts 94 which are held in place by screws (not shown) and extend from inner sidewalls 96. The lower brush 22 is held in place by a brush retainer nut/washer 116 as are side brushes 20, 26. Preferably, exterior sidewalls 118 of the mutually opposed upper portions 120 of the housing 38 are removable to allow access to the transmission assembly for servicing.

A coupler link 102 is pivotally connected at its lower end to lower side gears 90 by way of a short shaft 104 extending from the lower side gears 90, and to the upper side gears 106 by way of a short shaft 108 extending therefrom. Upper side gears 106 are supported by shafts 110 which extend from inner sidewalls 96. A sealed bearing 112 is disposed in sidewalls 96 to provide for smooth rotation of the shafts 110. Upper side gears 106 are connected to brushes 20, 26 through sidewalls 96 via shafts 110 which are surrounded by sealed bearings 112.

Figure 6:
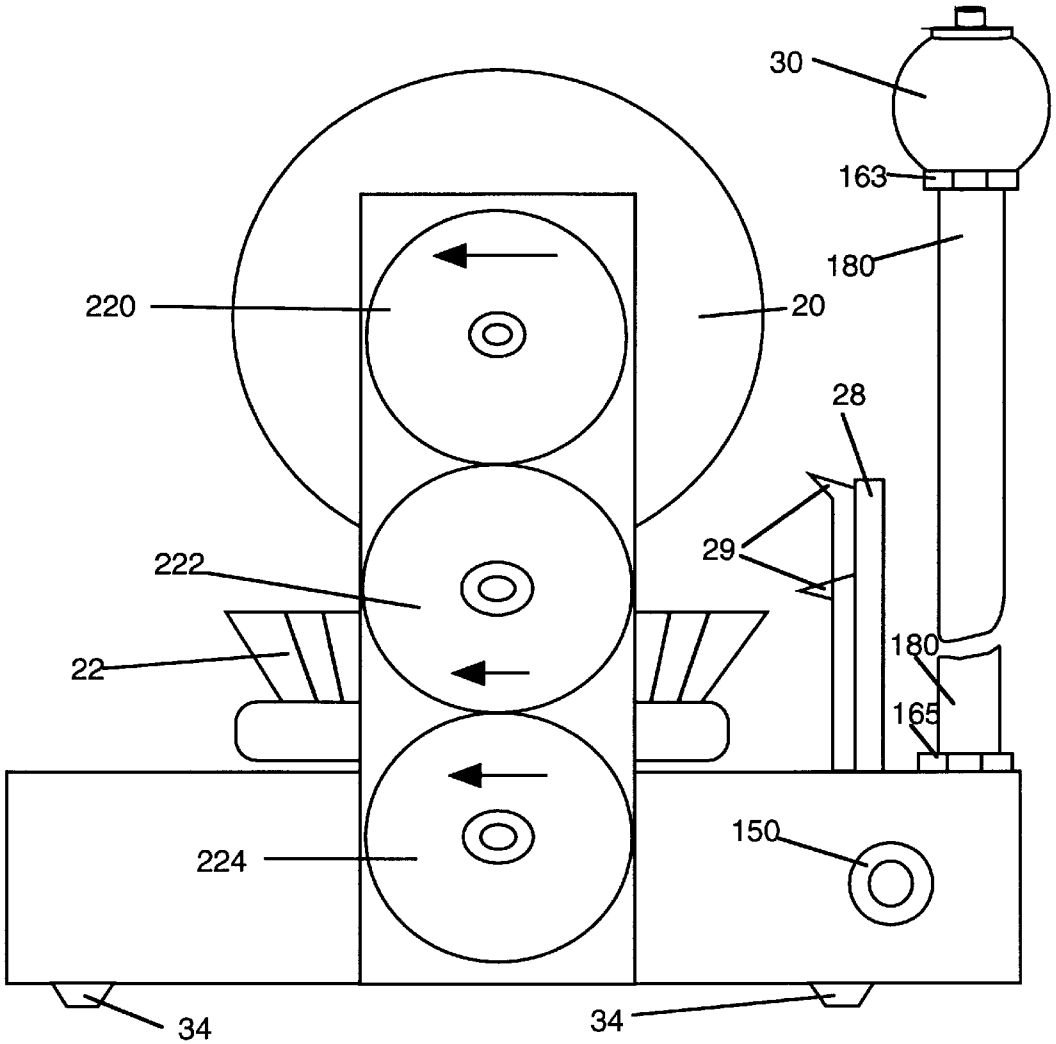
FIG. 6 is a side view, partly in section, of an alterative transmission arrangement of the boot and shoe cleaning apparatus which will cause continuous, single direction rotation of the associated brushes.
Figure 7:
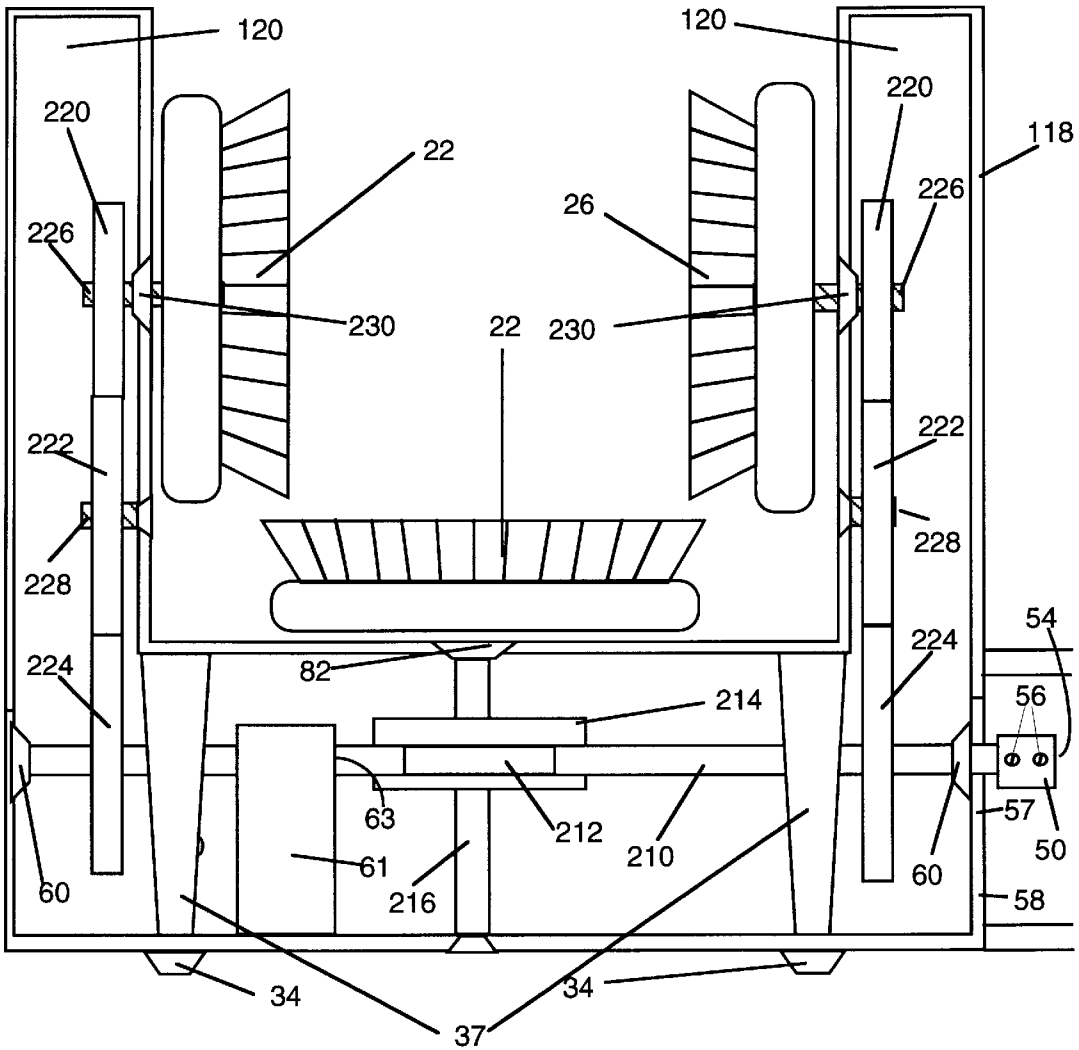
FIG. 7 is a front view, partly in section, of the alternative transmission arrangement of FIG. 6.

An alternative embodiment for a transmission to be used with the present invention 10 is shown in FIGS. 6 and 7. This embodiment provides for continuous rotation in a single direction. Although somewhat less effective, this embodiment is cheaper to manufacture because it has fewer moving parts.

This embodiment also has a drive shaft 210, which has a worm gear 212 which turns a gear 214 which is connected to lower brush 22 via shaft 216 thereby providing rotational energy thereto. Shaft coupling and sealed bearings are employed in the same manner as in the previous embodiment.

Rotational energy to the side brushes 20, 26 is supplied by upper and lower side brush gears 220, 222 which are meshingly coupled to drive gears 224 which are secured to the drive shaft 210. Support shafts 228, for the upper side brush gears are connected to the interior wall of the housing via screws as in the previous embodiment. Shafts 226 pass through sealed bearings 230 to brushes 20 and 26. Gears 222 contain sealed bearings and are secured on the shaft 228 with "c" rings. It can be readily appreciated that the use of sealed bearing where appropriate minimizes deleterious effects which may occur from continuous exposure to an outdoor environment. A support 61 is used to support shaft 210 as in the first embodiment.

Figure 9:
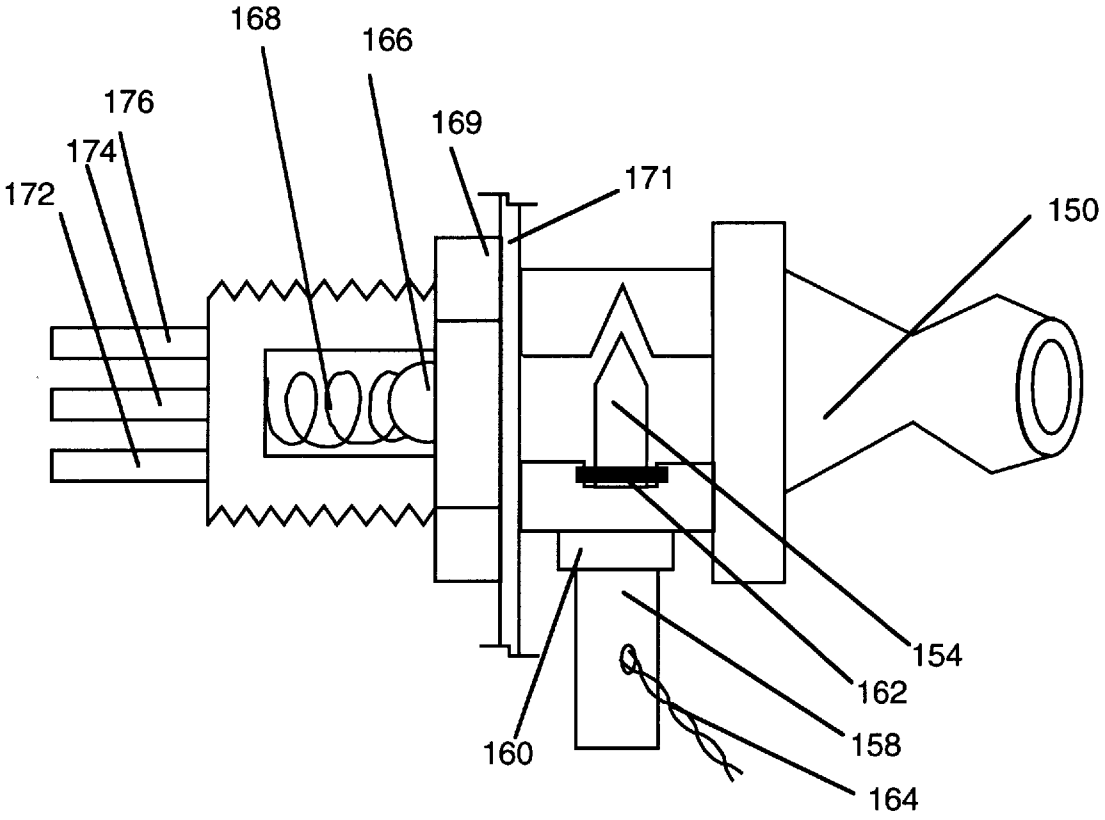
FIG. 9 is a top sectional view of the fluid inlet of the present invention.

Referring now to FIG. 9, the device 10 of the present invention may also have a source of fluid pressure connected thereto to effectively wash the boot or shoe of the user. The fluid may be used to loosen any dried mud, clay, etc., which may otherwise prove difficult to remove with brushes 20, 22, 26 and scraper 28. A cleaning agent such as detergent may be added to the fluid to enhance its effectiveness for certain applications.

A water inlet 150 employs a quick disconnect type of assembly, e.g., a bayonet type connector. Alternatively, an adapter (not shown) may be used with a standard female hose connector nut (not shown), the opposite end of the adapter threadably engaging a male end of a quick disconnect connector. A threaded nut 169 is secured to an interior surface of a wall 171 of the housing 38.

A solenoid controlled valve arrangement is used to permit fluid flow only when the switch 30 is engaged. The valve arrangement includes a solenoid actuated needle valve comprising a linearly retractable valve member 154 actuated by a solenoid 156 which is contained within cylindrical member 158. Valve member 154 completely shuts off fluid flow when fully advanced and seated within recess 159. Cylindrical member 158 is secured to inlet 150 via a fluid tight coupling 160 including O-ring seal 162. Power to the solenoid 156 is supplied by wire pair 164 which is selectively connected to a source of AC power by depressing switch 30. A step down transformer may be used to limit the voltage supplied to the wire pair 164 to eliminate the possibility of shock hazard in the event of failure of the fluid tight coupling 160.

A spring loaded check ball arrangement disposed in the inner conduit 165 comprising check ball 166 and spring 168 may be used provide a constant fluid flow regardless of variations in water pressure. It should be noted here that the spring loaded check ball arrangement may be employed without the solenoid controlled valve 154. Of course, an alternative means must be provided for selectively supplying fluid pressure to the inner conduit. Also, the solenoid controlled valve 154 may be used without the check ball arrangement. Three nozzle conduits 172, 174, 176 are fluidly coupled to inner conduit 165 at one end and to the nozzles 29 at the opposite end for supplying fluid flow to the nozzles 29. It should be noted here that the central nozzle 29 has a bifurcated tip for spraying on the left and right sides of the lower brush 22 simultaneously thereby enhancing the cleaning action.

Figure 8:
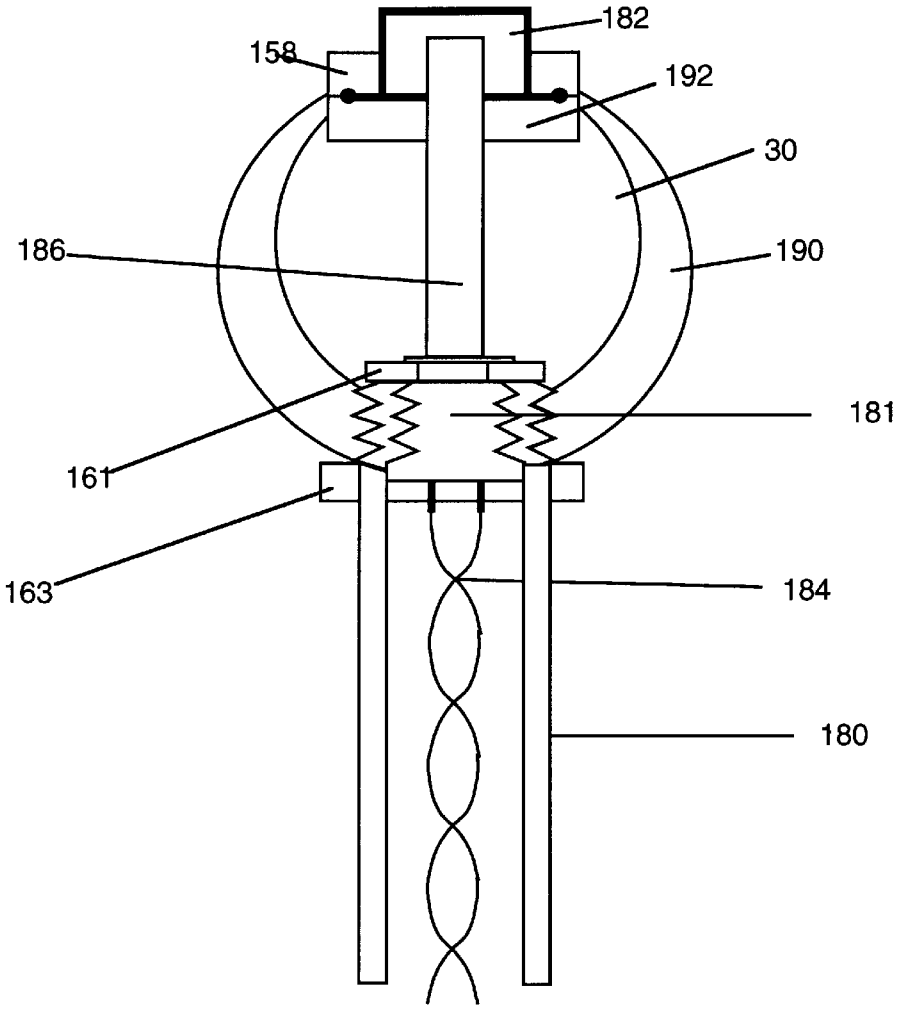
FIG. 8 is a is a sectional view of a starter switch of the boot and shoe cleaning apparatus of the present invention.

Referring now to FIG. 8, the switch 30 is shown in more detail. The switch member 30 is connected to the housing 38 by an extended shaft 180 having a hollow interior. The switch member 30 contains a spring loaded press and hold switch assembly 181 of the type well known in the switch art. The switch assembly 181 is connected to motor 44 via twisted wire pair 184 which passes through the interior of shaft 180 into the interior of housing 38. A central bore formed in the rubberized cover of the switch assembly 181 is used to engage the top of post 186 (which is part of switch 181). A locking nut 162 is used at the top of switch 181 to further secure the switch assembly 181 to shaft 180. The switch post 186 is made sufficiently tall to ensure it protrudes from the top of the switch member 30. The switch post 186 is covered by rubberized material 182 to protect against corrosion or other damage due to the ambient environment. The rubberized material 182 is held in place by securing nuts 158 and 192. Any equivalent commercially available spring loaded momentary contact switch may be used as the switch within switch member 30.

In operation, a user may place his soiled boot or shoe on lower brush 22 and commence the cleaning operation by pressing and holding switch post 186 thereby commencing rotation/oscillation of brushes 20, 22, 26. The user may then place his boot or shoe onto brush 22 and manipulate the boot or shoe allowing it to contact scraper bar 28 and side brushes 20 and 26. If the device has nozzles 29 fluidly connected to a source of fluid pressure, pressing and holding switch post 186 will cause retraction of valve member 154 thereby permitting fluid flow to nozzles 29. Fluid from nozzles 29 will come into contact with brushes 20, 22, 26 and the boot or shoe of the user thereby loosening any mud, dirt, etc., which may be on the boot or shoe of the user. Releasing switch post 186 will cause the rotation of brushes 20, 22, 26 to stop, and will cause valve member 154 to advance until it seated within recess 159 thereby shutting off fluid flow to nozzles 29. Cleaning of the brushes 20, 22, 26 may be effected by pressing and holding switch post 186 which will cause a sufficient amount of fluid to come into contact with brushes 20, 22, 26 to loosen debris which may become lodged therein.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A boot and shoe cleaning apparatus comprising:

a housing, said housing having front and rear and two sides;

a motor and transmission assembly, said transmission assembly disposed in said housing, said motor operatively connected to the transmission assembly, the transmission assembly having a plurality of gears meshingly coupled to drive shafts connected to at least two side brushes and at least one lower brush;

said side brushes positioned exteriorly of said housing and rotating about generally horizontal axes, and said lower brush extending exteriorly of said housing and rotating about a generally vertical axis;

a horizontal scraper bar attached to and extending from the rear of said housing;

and means for selectively applying power to said motor to cause rotation of said brushes, whereby bottom and side portions of a boot or shoe may be effectively cleaned by placing said boot or shoe into contact with said rotating brushes.

2. The apparatus of claim 1 wherein said apparatus includes a conduit fluidly coupled at one end to a source of fluid pressure, said conduit being fluidly coupled at an opposing end to a plurality of nozzles, said nozzles positioned to direct a stream of fluid to each of said brushes.

3. The apparatus of claim 2 wherein said fluid may be water with a cleaning agent dispersed therein.

4. The apparatus of claim 2 wherein said nozzles are attached to and supported by said scraper bar.

5. The apparatus of claim 1 wherein said housing further includes a pair or mutually opposed upstanding portions, said upstanding portions containing a major part of said transmission means.

6. The apparatus of claim 5 wherein said mutually opposed upstanding portions have a removable panel to allow access to said transmission means.

* * * * *